US005851133A

United States Patent [19]

Hofmann

[11] Patent Number: 5,851,133

[45] Date of Patent: Dec. 22, 1998

[54] FED SPACER FIBERS GROWN BY LASER DRIVE CVD

[75] Inventor: James J. Hofmann, Boise, Id.

[73] Assignee: Micron Display Technology, Inc., Boise, Id.

[21] Appl. No.: 773,022

[22] Filed: Dec. 24, 1996

[51] Int. Cl.[6] ..... H01J 31/00

[52] U.S. Cl. ..... 445/24

[58] Field of Search ..... 445/24, 25

[56] References Cited

U.S. PATENT DOCUMENTS

| | | | |
|---|---|---|---|
| 3,424,909 | 1/1969 | Rougeot | 250/207 |
| 3,979,621 | 9/1976 | Yates | 313/105 CM |
| 3,990,874 | 11/1976 | Schulman | 65/4 B |
| 4,091,305 | 5/1978 | Poley et al. | 313/220 |
| 4,183,125 | 1/1980 | Meyer et al. | 29/25.15 |
| 4,451,759 | 5/1984 | Heynisch | 313/495 |
| 4,705,205 | 11/1987 | Allen et al. | 228/180.2 |
| 4,923,421 | 5/1990 | Brodie et al. | 44/24 |
| 4,940,916 | 7/1990 | Borel et al. | 313/306 |
| 5,070,282 | 12/1991 | Epsztein | 315/383 |
| 5,136,764 | 8/1992 | Vasquez | 29/25.01 |
| 5,151,061 | 9/1992 | Sandhu | 445/24 |
| 5,205,770 | 4/1993 | Lowrey et al. | 445/24 |
| 5,229,691 | 7/1993 | Shichao et al. | 315/366 |
| 5,232,549 | 8/1993 | Cathey et al. | 456/633 |
| 5,324,602 | 6/1994 | Inada et al. | 430/23 |
| 5,329,207 | 7/1994 | Cathey et al. | 315/169.1 |
| 5,342,477 | 8/1994 | Cathey | 156/643 |
| 5,342,737 | 8/1994 | Georger, Jr. et al. | 430/324 |
| 5,347,292 | 9/1994 | Ge et al. | 345/74 |
| 5,371,433 | 12/1994 | Home et al. | 313/495 |
| 5,374,868 | 12/1994 | Tjaden et al. | 313/310 |
| 5,391,259 | 2/1995 | Cathey et al. | 156/643 |
| 5,413,513 | 5/1995 | Home et al. | 445/24 |
| 5,445,550 | 8/1995 | Xie et al. | 445/24 |
| 5,448,131 | 9/1995 | Taylor et al. | 313/309 |
| 5,449,970 | 9/1995 | Kumar et al. | 313/495 |
| 5,486,126 | 1/1996 | Cathey et al. | 445/25 |
| 5,561,343 | 10/1996 | Lowe | 445/24 X |
| 5,629,583 | 5/1997 | Jones et al. | 445/24 |

FOREIGN PATENT DOCUMENTS

| | | |
|---|---|---|
| 0690472 A1 | 1/1996 | European Pat. Off. . |
| 2-165540(A) | 6/1990 | Japan . |
| 3-179630(A) | 8/1991 | Japan . |

OTHER PUBLICATIONS

Wallenberger, Frederick T., *Science,* vol. 267, 3 Mar. 1995, Rapid Prototyping Directly from the Vapor Phase, pp. 1274–1275.

Boman, M. et al., 1992 *IEEE,* "Helical Microstructures Grown By Laser Assisted Chemical Vapour Deposition", pp. 162–167.

*Primary Examiner*—Kenneth J. Ramsey
*Attorney, Agent, or Firm*—Hale and Dorr LLP

[57] ABSTRACT

Laser-assisted chemical vapor deposition is used to form spacers at desired locations in a field emission display. The spacers can be designed with different shapes to provide increased strength and also to be formed differently depending on the their location on the display.

8 Claims, 6 Drawing Sheets

FED SPACER FIBERS GROWN BY LASER DRIVE CVD

BACKGROUND OF THE INVENTION

The present invention relates to displays, and more particularly to processes for forming spacers in a field emission display (FED).

Referring to FIG. 1, in a typical FED (a type of flat panel display), a cathode 21 has a substrate 11 of single crystal silicon or glass. Conductive layers 12, such as doped polysilicon or aluminum, are formed on substrate 11. Conical emitters 13 are constructed on conductive layers 12. Surrounding emitters 13 are a dielectric layer 14 and a conductive extraction grid 15 formed over dielectric layer 14. When a voltage differential from a power source 20 is applied between conductive layers 12 and grid 15, electrons 17 bombard pixels 22 of a phosphor coated faceplate (anode) 24. Faceplate 24 has a transparent dielectric layer 16, preferably glass, a transparent conductive layer 26, preferably indium tin oxide (ITO), a black matrix grille (not shown) formed over conductive layer 26 and defining regions, and phosphor coating over regions defined by the grille.

Cathode 21 may be formed on a backplate or it can be spaced from a separate backplate. In either event, cathode 21 and faceplate 24 are spaced very close together in a vacuum sealed package. In operation, there is a potential difference on the order of 1000 volts between conductive layers 12 and 26. Electrical breakdown must be prevented in the FED, while the spacing between the plates must be maintained at a desired thinness for high image resolution.

A small area display, such as one inch (2.5 cm) diagonal, may not require additional supports or spacers between faceplate 24 and cathode 21 because glass substrate 16 in faceplate 24 can support the atmospheric load. For a larger display area, such as a display with a thirty inch (75 cm) diagonal, several tons of atmospheric force will be exerted on the faceplate, thus making spacers important if the faceplate is to be thin and lightweight.

SUMMARY OF THE INVENTION

The present invention includes methods for forming spacers in a display device using chemical vapor deposition (CVD), and methods for forming spacers with different shapes and configurations. According to this method, spacers are grown on a substrate by directing an energy source to provide energy at a desired location to produce a solid from a gaseous vapors. In preferred embodiments, the spacers are formed with strength-enhancing configurations and shapes, such as I-shaped or T-shaped cross-sections in a plane perpendicular to the substrate, or X-shaped cross-sections in a plane parallel to the substrate. The spacers can be made accurately with different heights so that the spacers in the center of the device can be made longer than those at one or both sets of parallel edges such that the faceplate of the display bows outwardly slightly so that external pressure is more evenly distributed if the device is hit by impact. The substrate with the spacers formed thereon is then processed to form a first plate that is then assembled with a parallel second plate and vacuum sealed close together.

The present invention also includes a display, preferably a field emission display, that has a number of spacers between a cathode and a faceplate/anode vacuum-sealed together in parallel in a package. The spacers can have cross-sectional profiles, such as a T-shaped or I-shaped, or X-shaped cross-sections to enhance strength.

The present invention provides a method for forming spacers accurately, in desired locations, with materials and configurations that are stronger than known spacers, such as bonded glass spacers. The spacers in the display are less susceptible to breaking due to shear forces from handling, and can avoid the need for bonding, polishing, and/or planarizing. Other features and advantages will become apparent from the following detailed description, drawings, and claims.

DETAILED DESCRIPTION

Figure 1:
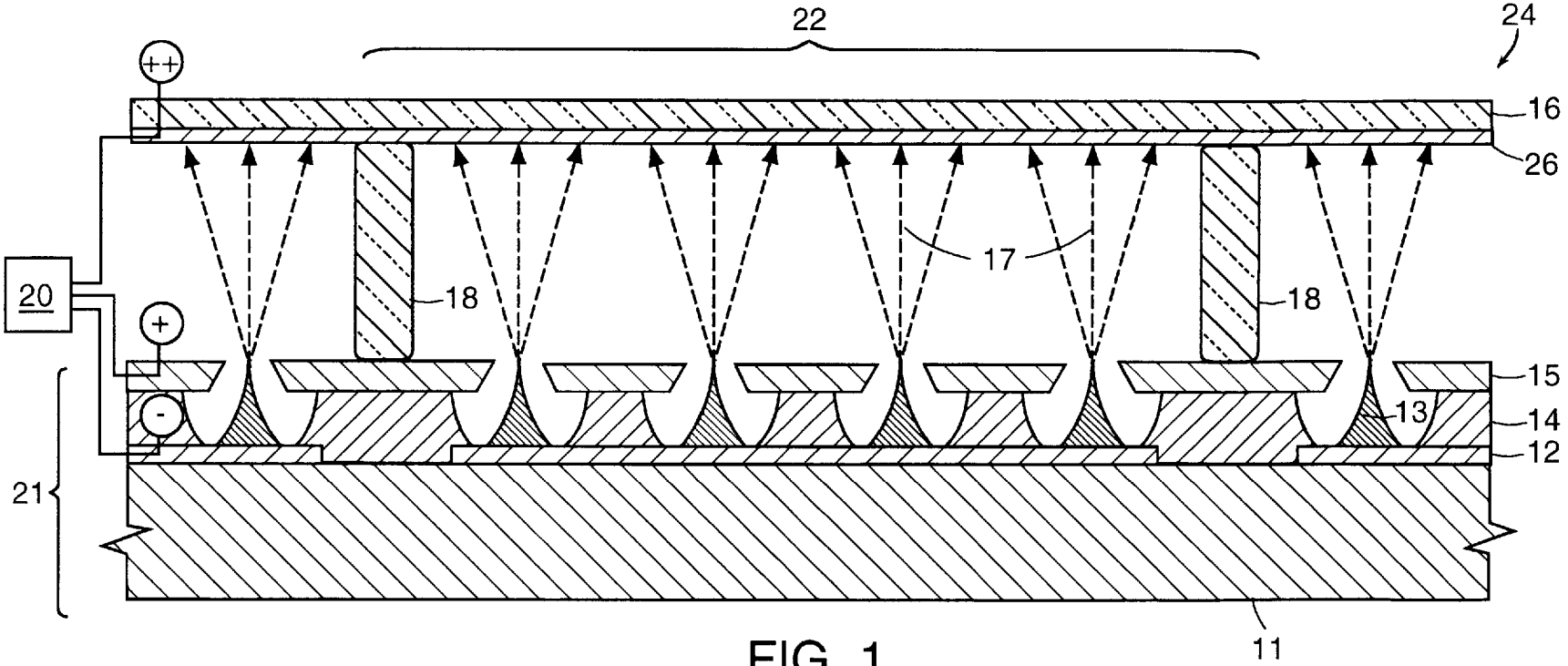
FIG. 1 (PRIOR ART)
FIG. 1 is a cross-sectional view of a known FED.
Figure 2:
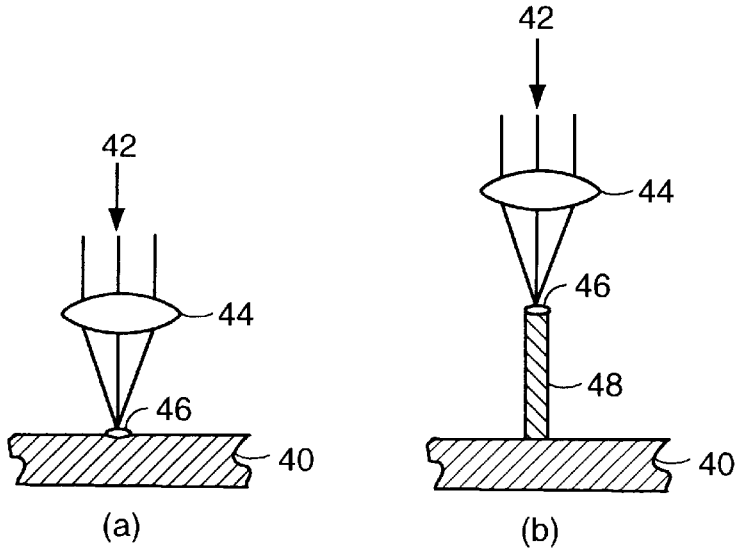
FIGS. 2(*a*)–(*b*) are side views illustrating steps in a method system for forming spacers on a substrate.

Referring to FIGS. 2(*a*)–(*b*), a method for growing a spacer on a substrate 40 is pictorially represented. In a chamber with appropriate gases, an energy beam, preferably a laser beam 42 from an argon laser or a Nd-YAG laser, is focused by a lens 44 to produce a focus spot 46 on a substrate 40. The laser provides heat at the spot to grow a rod with a chemical vapor deposition (CVD) process. Substrate 40 is moved relative to lens 44 to stimulate the CVD process to continue to grow spacer 48 outwardly from substrate 40. Laser-assisted CVD processes are described in more detail in Westberg, et al., "Proc. Transducers '91", 1991; Boman, et al., "Helical Microstructures Grown By Laser-Assisted Chemical Vapour Deposition", Micro Electro Mechanical Systems, 1992; and Wallenberger, "Rapid Prototyping Directly From the Vapor Phase", Science, 3 Mar. 1995. These papers, which are incorporated herein by reference for all purposes, show generally that structures can be formed on a substrate using such a process.

Figure 3:
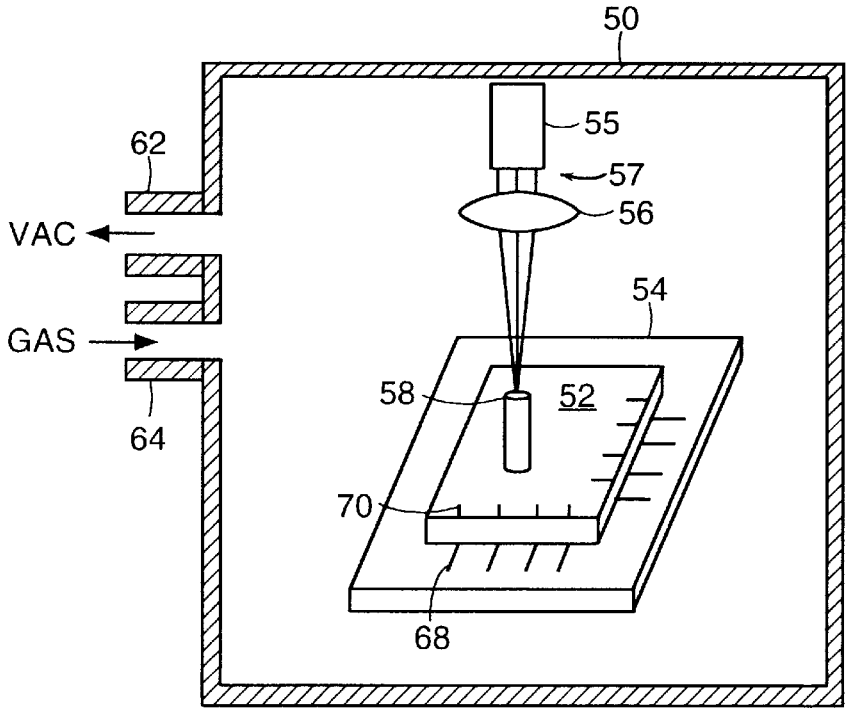
FIG. 3 is a perspective view of a reaction chamber for producing spacers according to the present invention.

Referring to FIG. 3, such spacers are produced in a reaction chamber 50 that has a solidifiable material in a vapor phase. Chamber 50 has an outlet 62 that leads to a pump (not shown) for pumping down the chamber to a vacuum. The CVD process is performed with two or more gases, including at least a precursor gas and an activator gas, introduced into chamber 50 through an inlet 64 into chamber 50 after chamber is evacuated. Inlet 64 and outlet 62 could be replaced by a single opening connected to a three-way valve to first pump out air and other undesired gases, and then to establish a connection from the gas source to fill chamber with the reactive gases. These gases react to form a solid material when sustained by a suitable heat-providing energy source.

In the chamber, a substrate 52 is supported in chamber 50 on a platform 54. A laser 55 provides acollimated beam 57 to focusing lens 56 to heat a spot 58 and thereby stimulate a reaction at that spot. As spacer 60 grows, substrate 52 and platform 54 are moved relative to and away from laser 55 and lens 56 so that the spot moves in a direction transverse to the plane of substrate 52. After the spacer is grown, laser 55 is turned off and one or both of substrate 52 and laser 55 is moved relative to the other so that another spacer can be formed at a new location. Spacers can thus be grown one at a time at a number of sites on substrate 52. Alternatively, multiple lasers or appropriate beam splitting could allow multiple spacers to be produced simultaneously on one substrate.

The two reaction gases may undergo a vapor-liquid-solid phase transformation, i.e., the gas may be deposited as a liquid that solidifies, or the two reaction gases under go a vapor-solid phase transformation, i.e., a solid film or solid coating is formed directly from a gaseous state. An exemplary material for such structures is boron formed from $BCl_3$ and $H_2$ to produce solid boron and HCl gas that is pumped out of chamber 50. Such a CVD process can also be used to produce silicon or aluminum rods. In such a case, because it is undesirable for the spacers to be conductive, oxygen is introduced under partial pressure to produce silica ($SiO_2$) or alumina ($Al_2O_3$) so that the spacers are made of a dielectric material. Other materials, such as carbon, silicon nitride, silicon carbide, and germanium could also be grown with CVD techniques. Indeed, any material that can produce a dielectric film by conventional CVD can potentially yield a free-standing spacer.

The pressure can be very low, i.e., much less than 1 bar, although higher pressures can be used to achieve faster growth rates, i.e., of up to 1100 microns per second for a small diameter (<20 microns) boron fiber.

To grow the spacers, the beam spot can be kept stationary while substrate 52 is clamped to a table 54 that is movable along three mutually orthogonal coordinate axes (x, y, z), with the z-axis being the direction along which the spacers are formed. By appropriately indexing the x and y coordinates, spacer sites are selected to define an array of spacers on the surface of the substrate. As shown in FIG. 3, alignment marks 68 can be provided on table 54 and corresponding alignment marks 70 on the substrate 52 to allow the coordinate system of the table to be calibrated to the coordinate system of the substrate. Alternatively, rather than moving table 54, laser 55 and focusing lens 56 can be relative to table 54 to form the spacers.

With this process, the spacers can thus be grown to a precise height. Consequently, the need for planarization and/or polishing of spacers, steps that are performed with other techniques for forming spacers, can be avoided.

Figure 4:
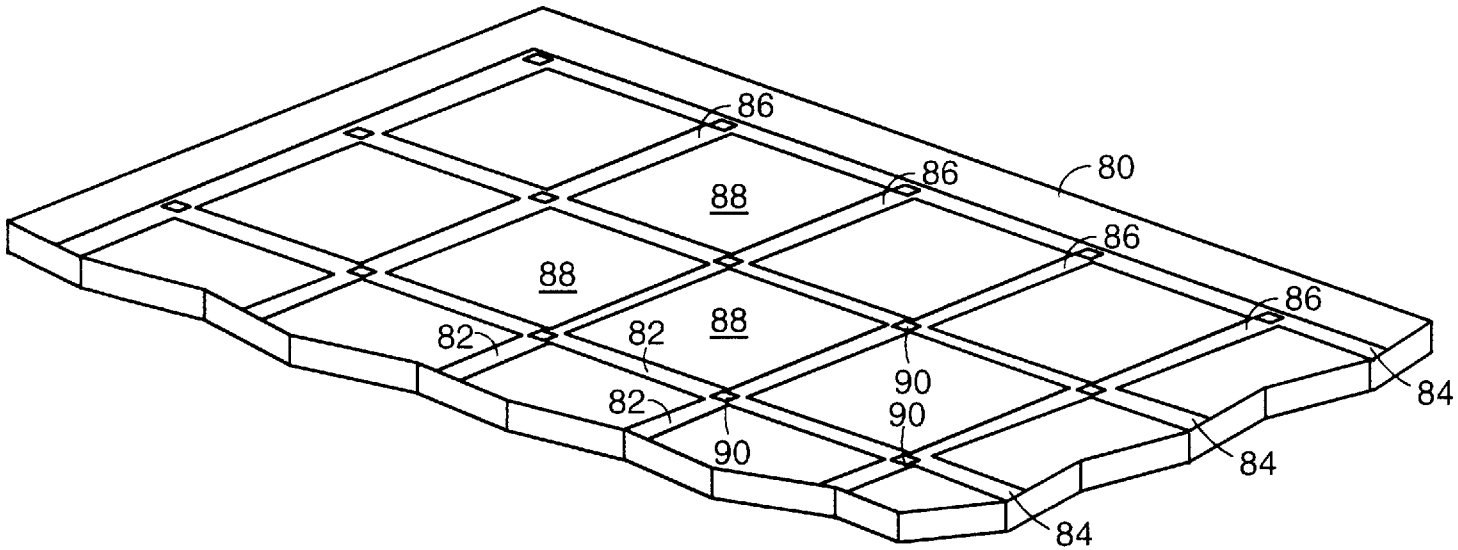
FIG. 4 is a perspective view illustrating a portion of an anode (or faceplate) with location sites for spacers.

Referring to FIG. 4, in an FED, the spacers are preferably formed on the faceplate/anode. In this embodiment, a substrate 80 includes a glass layer and a conductive layer, such as indium tin oxide (ITO), formed over the glass. A black matrix grille 82 is formed over substrate 80 with rows 84 and columns 86 that define rectangular regions 88. These regions will later be coated with phosphor particles and will serve as pixels in the display. Rows 84 and columns 86 also define intersections 90 where the spacers are preferably formed because there is no light image being produced at these intersections. In an alternative structure to that of FIG. 4, the grille can be formed over the glass, followed by the conductive layer over the grille and the glass. Spacers are still formed over intersection points, but the spacers are formed directly on the conductive layer rather than on the grille.

The spacers are thus formed directly on a substrate, without the need to bond the spacers with an adhesive. It would be understood that different spacer materials may be matched to the substrate material for chemical compatibility and thermal expansion by the addition of thin films that is disposed between the spacer and substrate. These thin films may be made from aluminum oxide, silicon oxide, or aluminum silicon oxide, or other suitable material. This is because this category of materials will have excellent adhesion, temperature stability and chemically compatible with the both the spacer material and the substrate material. Also it would be understood that annealing or heat treating after bonding or fabrication of the spacers to eliminate stress at the interface or achieve densification may be desirable.

The aspect ratio, i.e., the ratio of the diameter to the height of the spacers, can be controlled precisely by the size of the laser spot and the distance of relative displacement of the spot and the spacer site on the substrate. The aspect ratio is preferably between 5:1 and 20:1, and more preferably about 10:1; in absolute figures, the spacer diameter should be about 20–25 microns, and the spacer height should be about 200–250 microns, the approximate distance between the faceplate and the cathode.

Figure 5:
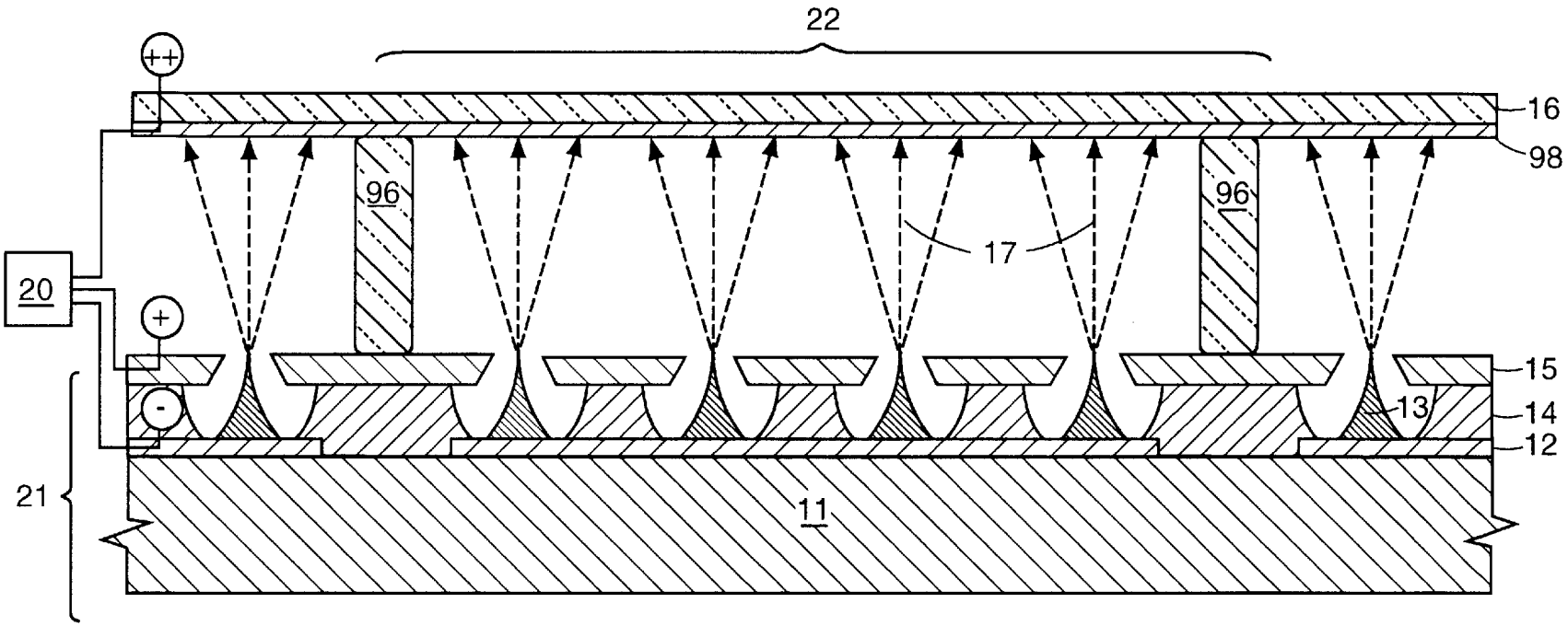
FIGS. 5 and 6 are cross-sectional views of field emission displays with spacers.

FIG. 5 illustrates an FED display that has spacers 96 formed directly on faceplate substrate 16, preferably at locations where intersection sites of a grille would be. In this case, after spacers 96 are formed on substrate 16, the faceplate is further processed by forming a conductive layer 98 and a grille (not shown) over substrate 16. The spacers bridge the thin gap between the faceplate and cathode and rest on grid 15 of the cathode, preferably without adhesive. The cathode and faceplace are very thin compared to their area and thus can be considered planar with the spacers extending perpendicular to the plane of both the cathode and faceplate. As is noted below, the faceplate can be formed to bow slightly relative to the cathode, but his slight difference would not substantially change the generally planar nature of the faceplate.

Figure 6:
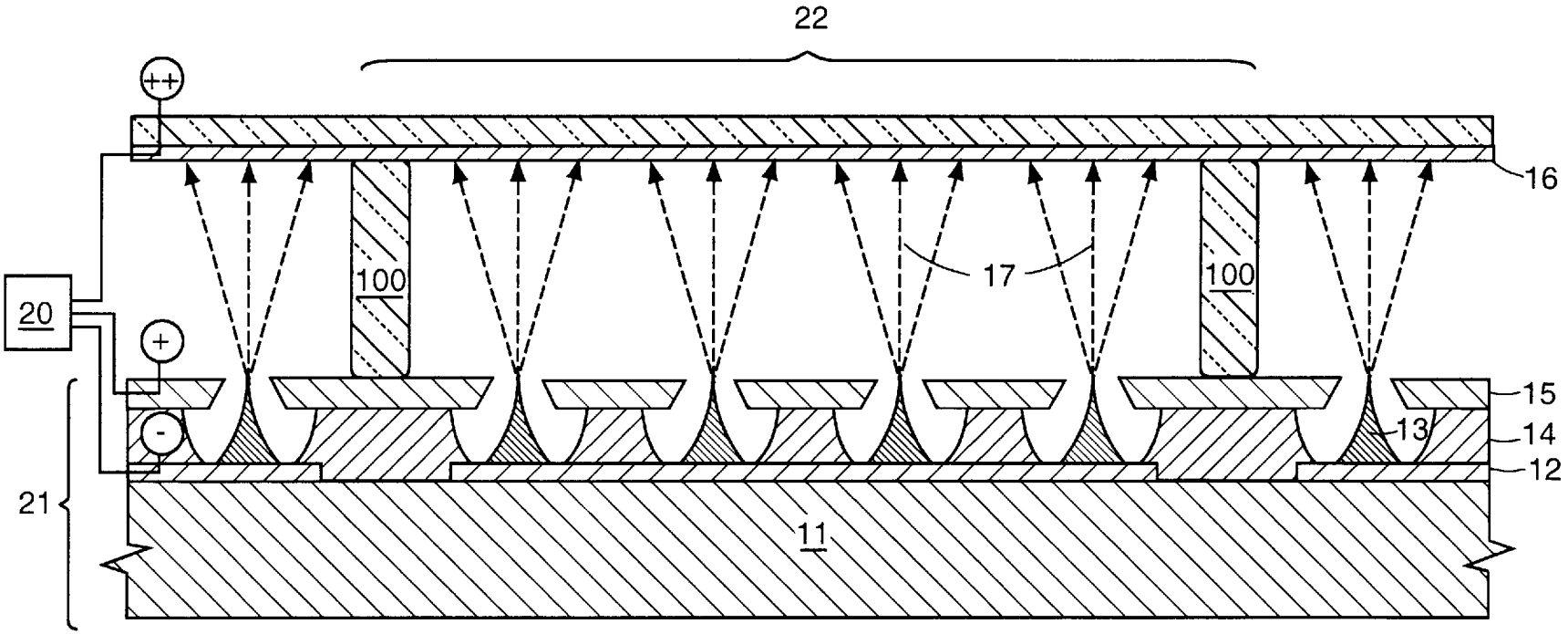

FIG. 6 shows a display with spacers 100 formed on substrate 11 of cathode 21. After the spacer is formed on substrate 11, the cathode is then further processed by forming conductive layers 12, emitters 13, layer 14, and grid 15 over substrate 11. Accordingly, in both the embodiments of FIG. 5 and FIG. 6, the spacers extend perpendicular to the faceplate and cathode to bridge the vacuum gap therebetween.

The focused CVD process of forming spacers as described above allows spacers to be formed with different precise heights and also in arbitrary shapes. In another aspect of the invention, these capabilities are exploited to enhance the strength of a structure, particularly a flat panel display, and more particularly an FED.

Figure 7:
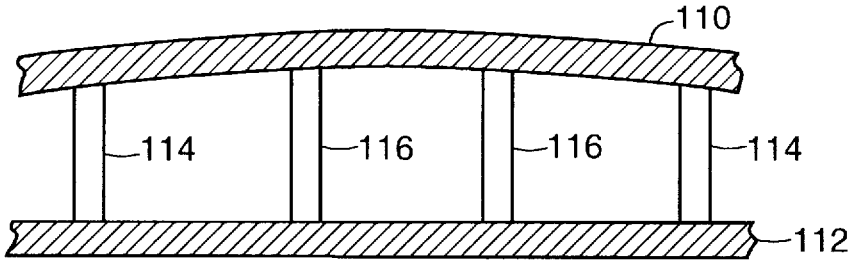
FIG. 7 is a side view of a display with spacers having different heights.

Referring to FIG. 7, in a flat panel display, it may be desirable for spacers in the center of the display to be longer than spacers at two of the parallel edges or at all of the edges so that the force of impacts to the center of the display are distributed among more spacers, thus reducing the risk of spacers being broken. Accordingly, in another aspect of the present invention, a display has two parallel plates, shown here generally as a faceplate/anode 110 and a cathode 112, with plates 110 and 112 spaced close together and vacuum sealed. These plates are separated by spacers having different heights such that spacers 116 in the center are slightly higher than spacers 114 at the sides so that the faceplate is very slightly bowed outwardly relative to cathode 112.

In a rectangular display, there are two sets of parallel sides. The bowing can be in one dimension or two, depending on whether the faceplate is bowed along two of the parallel sides or all four sides. If two sides are bowed, the faceplate of the display will have a curved cross-section in one direction, but will have the same cross-section along the orthogonal direction, while if four sides are bowed, the center of the display will be at a different height than all of the edges.

It would be understood that the relationship between the strength and height of spacers is determined by the expression 1:

$$P = \frac{\Pi^2 \cdot E \cdot I}{L^2}$$

where,

P=the critical loading of the spacer (lbs.)

E=the elastic modulus of the spacer material (lbs./in$^2$)

I=the moment of inertia (lbs./in$^4$)

L=the height of the spacer (inches)

Therefore, as the height of the spacer increases, a reduction in strength is experienced as shown, for example, in Table 1:

| Height ($\mu$m) | $L^2$ ($\mu m^2$) | Strength (Pascals) | % Reduction in Strength |
|---|---|---|---|
| 250 | 62500 | 1264 | n/a |
| 255 | 65025 | 1213 | 96% |
| 260 | 67600 | 1125 | 89% |

Figure 8:
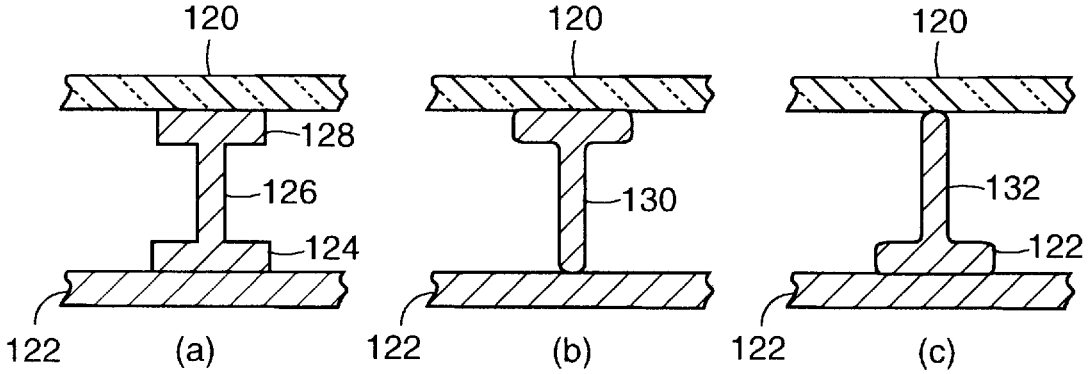
FIGS. 8(*a*)–(*c*) and 9(*a*)–(*b*) are cross-sectional views of spacers, illustrating different possible shapes and configurations.

Referring to FIGS. 8(*a*)–(*c*), the present invention also includes a display device having a first plate 120 and a second plate 122 vacuum sealed close together in a package. To protect against forces from impacts against the display and particularly those directed along the direction of the elongated portion of the spacers, the spacers can be T-shaped or I-shaped to help distribute the force. To produce an I-shaped spacer, for example, and referring to FIGS. 3 and 8(*a*), a laser spot is moved in the x-y plane to form a base portion 124, then a vertical member 126 is formed by moving the beam spot along the z-axis, followed by further movement of the laser spot in the x-y plane to produce a top portion 128. Alternatively, the larger top and base portions can be formed with a wider beam spot.

FIGS. 8(*b*) and 8(*c*) show spacers 130 and 132, respectively, with a T-shape and an inverted T-shape. All of these shapes help distribute forces by having one or more wider portions that can be formed by moving the spot in the x-y plane or with a larger spot and elongated portions along the direction perpendicular to the plates.

Figure 9:
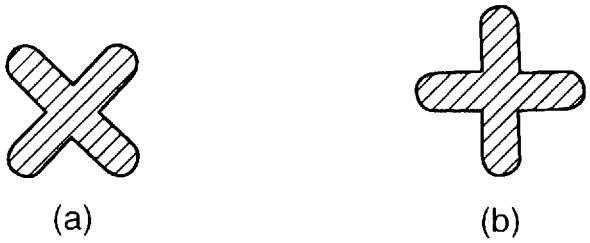

In another embodiment, referring to FIGS. 9(*a*) and (*b*), a number of spacers can be made with an X-shaped cross section to help protect against shearing forces that are perpendicular to the elongated direction of the spacers. Furthermore, such spacers can be aformed in different ways at at different locations of the display. For example, the X-shaped spacers can have two orientations that are offset by 45? relative to each other.

Having described a number of embodiments of the present invention, it should be apparent that other modifications can be made without departing from the scope of the invention as defined by the appended claims.

I claim:

1. A process comprising the steps of:

introducing a number of different gases into an evacuated chamber;

directing energy with an energy source to a spot on a substrate to cause the gases to form a solid;

moving the energy source relative to the substrate to form a spacer extending away from the substrate; and assembling together the substrate with the spacer and a parallel plate in a vacuum sealed package such that the spacer is perpendicular to the substrate and the parallel plate.

2. The process of claim 1, wherein the directing step includes directing a laser beam through a focusing lens.

3. The process of claim 1, wherein the forming step includes forming a spacer with a X-shaped cross-section in a plane parallel to the substrate and the plate.

4. The process of claim 1, wherein the spacer has a I-shaped cross-section in a plane perpendicular to the substrate and parallel plate.

5. The process of claim 1, wherein the spacer has a T-shaped cross-section in a plane perpendicular to the substrate and parallel plate.

6. A process comprising the steps of:

introducing one or more gases into an evacuated chamber;

directing energy with an energy source to a spot on a transparent substrate;

moving the energy source relative to the substrate to form a spacer extending away from the substrate;

forming a phosphor coating on the substrate;

assembling together the substrate with a cathode that has a plurality of electron emitters, the cathode being assembled so that the emitters emit electrons toward the substrate when excited to produce a visible image at the faceplate, the assembling step being performed so that the spacer contacts a portion of the cathode and the cathode and substrate are sealed together in a vacuum sealed package.

7. The process of claim 6, further comprising the steps of repeating the directing and moving steps to form many spacers.

8. The process of claim 6, wherein the directing step includes directing the energy source so that the spacer has an elongated portion and a portion that is wider than the elongated portion, the wider portion contacting one of the substrate and the cathode.

* * * * *

UNITED STATES PATENT AND TRADEMARK OFFICE

CERTIFICATE OF CORRECTION

PATENT NO : 5,851,133

DATED : December 22, 1998

INVENTOR(S) : James J. Hofmann

It is certified that error appears in the above-identified patent and that said Letters Patent is hereby corrected as shown below:

In the Abstract, line 5, after the word "on", delete the word "the".

In Column 2, line 63, after the word "provides", insert a space between the "a" and the word "collimated", which is now shown as one word.

In Column 5, line 51, delete the first occurrence of the word "at".

In Column 5, line 52, change "45?" to --45°--.

Signed and Sealed this

Twentieth Day of April, 1999

*Attest:*

Q. TODD DICKINSON

*Attesting Officer*

*Acting Commissioner of Patents and Trademarks*